US012628947B2

(12) United States Patent
Stone

(10) Patent No.: US 12,628,947 B2
(45) Date of Patent: May 19, 2026

(54) MODULAR SHELVING AND METHOD

(71) Applicant: Paul R Stone, Provo, UT (US)

(72) Inventor: Paul R Stone, Provo, UT (US)

( * ) Notice: Subject to any disclaimer, the term of this patent is extended or adjusted under 35 U.S.C. 154(b) by 302 days.

(21) Appl. No.: 18/424,691

(22) Filed: Jan. 26, 2024

(65) Prior Publication Data

US 2024/0251942 A1 Aug. 1, 2024

Related U.S. Application Data

(60) Provisional application No. 63/441,352, filed on Jan. 26, 2023.

(51) Int. Cl.

| | |
|---|---|
| ***A47B 47/00*** | (2006.01) |
| ***A47B 96/02*** | (2006.01) |
| ***A47B 96/14*** | (2006.01) |
| *A47B 47/02* | (2006.01) |
| *A47F 5/08* | (2006.01) |

(52) U.S. Cl.

CPC ..... *A47B 47/0091* (2013.01); *A47B 96/025* (2013.01); *A47B 96/1433* (2013.01); *A47B 47/00* (2013.01); *A47B 47/028* (2013.01); *A47B 96/1441* (2013.01); *A47F 5/08* (2013.01)

(58) Field of Classification Search

CPC ..... A47B 47/0091; A47B 96/025; A47B 96/1433; A47B 47/00; A47B 47/0058; A47B 47/021; A47B 47/022; A47B 47/028; A47B 47/047; A47B 96/02; A47B 96/027; A47B 96/06; A47B 96/061; A47B 96/14; A47B 96/1441; A47F 5/08; A47F 5/0838

See application file for complete search history.

(56) References Cited

U.S. PATENT DOCUMENTS

| | | | | | |
|---|---|---|---|---|---|
| 426,313 | A | * | 4/1890 | Paxson | A47G 25/0685 211/99 |
| 1,545,072 | A | * | 7/1925 | Stearns | D06F 57/08 211/198 |
| 1,667,657 | A | * | 4/1928 | Dobert | A47B 5/04 33/8 |
| 1,677,764 | A | * | 7/1928 | Gloekler | A47J 47/16 193/38 |
| D105,885 | S | * | 8/1937 | McDonald | D6/566 |
| 3,233,852 | A | * | 2/1966 | Azar | A47B 96/027 248/68.1 |
| 3,388,807 | A | | 6/1968 | Emmitt | |

(Continued)

*Primary Examiner* — Devin K Barnett

(74) *Attorney, Agent, or Firm* — John D. Long, Esq.; LONG & CHYBIK

(57) ABSTRACT

A modular shelving system and method, the system comprising mounting brackets, a bottom shelving rod, a top shelving rod and a support shelving rod, the mounting brackets are attach to a vertical surface to support at least one bottom shelving rod and at least one top shelving rod in a spaced-apart and parallel orientation to each other shelving rod; the bottom shelving rod further defining tandem spaced-apart open-ended cups; the top shelving rod further defining spaced apart tandem top rod apertures that penetrate through the top shelving rod; at least one support shelving rod having a circumference that allows passage of one support shelving rod through a respective top rod aperture to allow a support shelving rod to removably connected to a respective open-end cup to locate the support shelving rod between horizontal and vertical positions.

20 Claims, 18 Drawing Sheets

(56) References Cited

U.S. PATENT DOCUMENTS

D214,923 S * 8/1969 Schier ..... D6/566
D282,995 S * 3/1986 Beverly ..... D6/567
4,854,456 A * 8/1989 Lee ..... A47B 81/007 211/175
5,040,808 A 8/1991 McIntyre
5,253,837 A * 10/1993 Loux ..... A47G 25/0692 211/90.01
D358,508 S * 5/1995 Levine ..... D6/678.4
D390,377 S * 2/1998 Whitehead ..... D6/567
D393,961 S * 5/1998 Whitehead ..... D6/552
5,871,105 A * 2/1999 Whitehead ..... A63B 71/0045 211/14
6,257,425 B1 * 7/2001 Liu ..... A47K 10/04 211/90.01
6,334,541 B1 * 1/2002 Chang ..... A47K 10/10 248/214
D467,446 S * 12/2002 Brass ..... D6/407
D472,084 S * 3/2003 Kollner ..... D6/513
6,561,364 B1 * 5/2003 Brunsden ..... A47K 10/04 211/90.01
6,581,788 B1 6/2003 Winig et al.
D478,758 S * 8/2003 Benjamin ..... D6/541
D487,369 S * 3/2004 Miller ..... D6/574
6,726,036 B2 * 4/2004 Koellner ..... D06F 57/12 211/172
D492,868 S * 7/2004 Ayers ..... D6/524
D493,320 S * 7/2004 Ayers ..... D6/574
D501,621 S * 2/2005 Ayers ..... D6/574
6,935,518 B2 8/2005 Winig et al.
D510,223 S * 10/2005 Jablow ..... D6/574
7,150,364 B2 * 12/2006 Jablow ..... A47B 45/00 211/175
7,201,282 B1 * 4/2007 Alderman ..... A47B 81/00 211/100
D635,447 S 4/2011 Henry
8,210,365 B2 * 7/2012 Van Wyk ..... A47B 81/00 211/85.3
8,453,852 B2 * 6/2013 Raddatz ..... D06F 57/12 211/85.24
8,596,590 B2 * 12/2013 McCoy ..... F16M 13/02 248/68.1
9,289,065 B1 * 3/2016 Lambertson ..... A47K 10/04
D813,566 S * 3/2018 Downey ..... D6/513
10,051,959 B1 * 8/2018 Glidewell ..... A47B 61/02
D854,102 S * 7/2019 Riekstina-Snore ..... D21/686
10,426,263 B1 * 10/2019 Whaley ..... A47B 77/14
10,506,877 B1 * 12/2019 Edwards ..... A47B 61/04
10,905,239 B2 * 2/2021 Newman ..... A47B 96/028
11,529,549 B2 * 12/2022 Henniger ..... A63B 1/00
12,370,428 B2 * 7/2025 Tribelhorn ..... A63B 71/0036
12,383,082 B1 * 8/2025 Bailey ..... A47F 5/0815
D1,096,230 S * 10/2025 Xie ..... D6/546
12,440,048 B2 * 10/2025 Smedley ..... A47B 96/028
2003/0192843 A1 * 10/2003 Winig ..... A47B 96/027 211/90.02
2007/0267372 A1 * 11/2007 Young ..... A47B 96/02 211/90.01
2009/0188879 A1 * 7/2009 Shieh ..... A47K 10/10 211/88.04
2009/0223912 A1 * 9/2009 Chen ..... A47K 10/10 211/48
2014/0170623 A1 * 6/2014 Jarstad ..... G09B 23/30 434/267
2018/0110346 A1 * 4/2018 Ott ..... A47B 96/061
2020/0085188 A1 * 3/2020 Feldman ..... A47B 47/0016

* cited by examiner

140
D
152
142
146
38
38
38
38
38
38
170
146
152
146
152
151
156
151
156
151
156

MODULAR SHELVING AND METHOD

STATEMENT REGARDING FEDERALLY SPONSORED RESEARCH OR DEVELOPMENT

Not Applicable.

REFERENCE TO A "MICROFICHE APPENDIX"

Not Applicable.

CROSS-REFERENCE TO OTHER APPLICATIONS

This application claims the benefit of U.S. Provisional Patent Application No. 63/441,352 filed on Jan. 26, 2023 and entitled "MODULAR SHELVING AND METHOD", the entire contents of which are incorporated by reference.

FIELD OF THE INVENTION

The present invention may relate to modular shelving comprising a set of spaced-apart mounting brackets that may be connected by a bottom shelving rod and a bottom a top shelving rod, the bottom shelving rod generally held in a lower horizontal position while a top shelving rod generally held in an upper horizontal position, the bottom shelving rod may be placed adjacent to a vertical surface by the mounting brackets while the top shelving rod may be placed distal from the vertical surface by the mounting brackets. More specifically, the present invention may relate to such modular shelving further comprising one or more parallel and spaced-apart support shelving rods passing through the top shelving rod to reach and be received by the bottom shelving rod.

BACKGROUND

One kind of modular shelving may comprise a set of mounting brackets and at least a set of connecting rods that may act as shelving. Wherein the mounting bracket (which could have an L-shaped configuration generally denoting vertical bracket arm connected to a horizontal bracket arm) may be placed in a spaced-apart configuration to engage a vertical structure (e.g., a wall) and thereby connect the modular shelving to said vertical structure. Each mounting bracket may further feature a set of spaced-apart rod apertures penetrating the mounting bracket (continuously connecting the mounting bracket sides.) The one group of rod apertures of the set of rod apertures may be aligned in tandem in vertical bracket arm while another group of rod apertures may be aligned in tandem in horizontal bracket arm.

Each rod of the set of connecting rods may engage and rest within respectively aligned apertures of respective mounting brackets to generally form the horizontal shelf portion of the modular shelving. Other rods from the set may also be passed through other vertically oriented mounting bracket apertures to provide a generally vertical wall counterpart to the generally horizontally shelf.

Such a modular shelving is generally a simple, easy and inexpensive way to erect vertical and horizontally shelving. This modular shelving may be limited to establishing horizontal, vertical or both shelving positions. These kinds of module shelving systems may not be able to provide an additional wide variety of additional angled shelfing configurations (e.g., located between horizontal and vertical positions) that may be used to hold a wide variety of materials or items that may require such angled and reconfigurable shelving. Such items may be tools such as hammers, screwdrivers, chisels, rolls of materials (e.g., rolls of tape), various shaped power tools, and the like whose storage could befit by having reconfigurable angled shelving.

SUMMARY OF ONE EMBODIMENT OF THE INVENTION

Advantages of One or More Embodiments of the Present Invention

The various embodiments of the present invention may, but do not necessarily, achieve one or more of the following advantages:

- provide a modular shelving system that establishes vertical, horizontal and other angled shelving portions;
- the ability to easily and economically provide a wide variety of shelving solutions with one modular shelving system;
- provide an easily established shelving unit that may be angled between horizontal and vertical positions;
- the ability to change the angle of the shelving structure; and
- provide a modular shelving system that can adjust the spacing between support shelving rods used to support stored material and items to allow portions of the stored materials to project between adjacent support shelving rods.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a modular shelving system comprising at least one support shelving rod and mounting brackets for supporting at least one bottom shelving rod and at least one top shelving rod; each mounting bracket further comprising an attachment device for attaching the mounting bracket to a vertical support, the at least one bottom shelving rod further configured to tandemly present a series of longitudinally-aligned open-ended cups, each open-ended cup further configured to receive and support a portion of the at least one support shelving rod, the at least one top shelving rod configured to tandemly present a series of longitudinally-aligned top rod apertures, each top rod aperture configured to allow passage of the portion of the at least one support shelving rod; wherein the mounting brackets support both the at least one top shelving rod and the at least one bottom rod, the least one top shelving rod being held above the at least one bottom rod, both the at least one top shelving rod and the at least one bottom rod are supporting the at least one support shelving rod in an angled position held between and horizontal position and a vertical position.

Another possible embodiment of the invention could be a modular shelving system comprising a set of mounting brackets, at least one bottom shelving rod, at least one top shelving rod and at least one support shelving rod, the mounting brackets may be configured for attachment to a vertical surface and for directly supporting at least one bottom shelving rod, at least one top shelving rod, the at least one top shelving rod passing through the at least one top shelving rod and coming to rest in the at least bottom shelving rod when the mounting brackets are attached to a vertical surface, the mounting brackets further are directly supporting the at least one bottom shelving rod and the at least one top shelving rod, wherein the at least one support shelving rod is held in angled position between horizontal and vertical orientations as well as being perpendicularly oriented to both at least one bottom shelving rod and the at least one top shelving rod.

Another possible embodiment of the invention could be a method for operating a modular shelving system comprising the follow steps, providing the modular operating system comprising a set of mounting brackets, at least one bottom shelving rod, at least one top shelving rod and at least one support shelving rod, the mounting brackets directly supporting at least one bottom shelving rod and at least one top shelving rod, the at least one support rod passing through the at least one top shelving rod and coming to rest in the at least bottom shelving rod when the mounting brackets are attached to a vertical surface, wherein the at least one support shelving rod is held in angled position between horizontal and vertical orientations as well as being perpendicularly oriented to both the at least one bottom shelving rod and the at least one top shelving rod, attaching the at least one bottom shelving rod and the at least one top shelving rod to the mounting brackets, passing the at least one support rod perpendicularly through the at least one top shelving rod so that one end of the at least one support rod rests within the bottom shelving rod; and holding the at least one support rod in a position between a horizontal and vertical positions.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
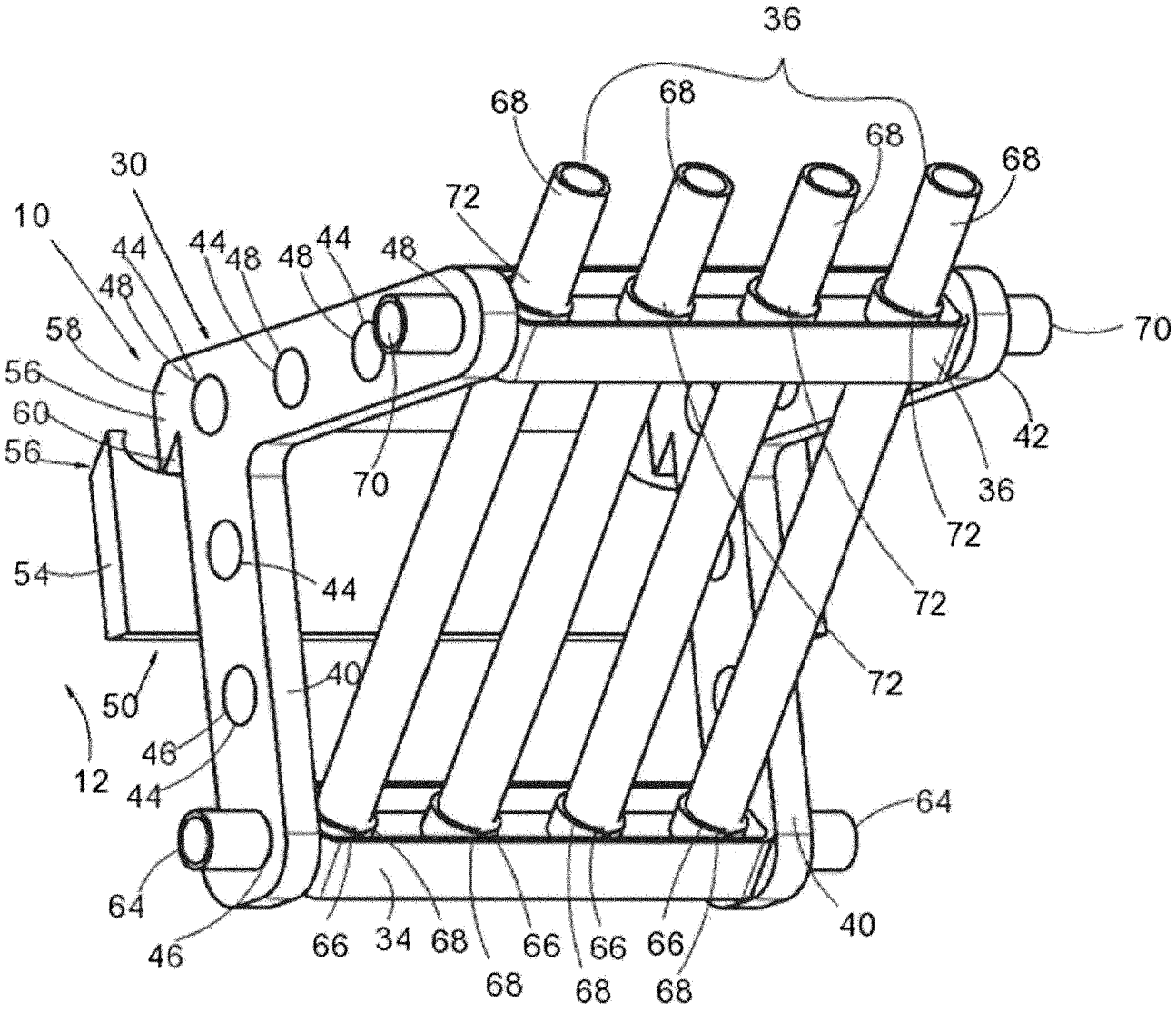
FIG. 1 is substantially a perspective view of one embodiment of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 may be a modular shelving system 30 and a method for operating same 100. As substantially shown in FIGS. 1 and 1A, the modular shelving system 30 could comprise a set of mounting brackets 32, one or more bottom shelving rods 34, one or more top shelving rods 36 and one or more support shelving rods 38 (e.g., a plain tubular rod).

Figure 1A:
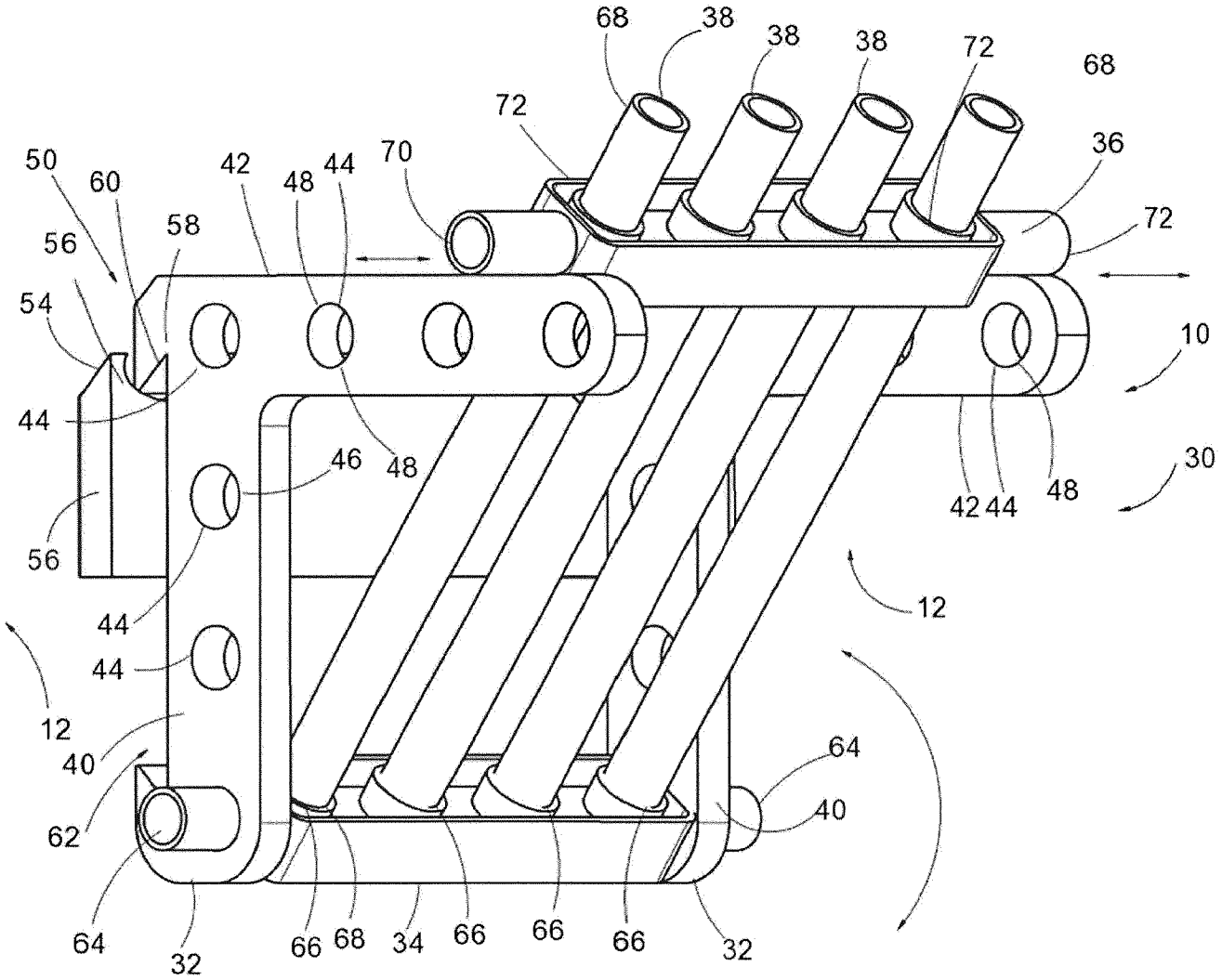
FIG. 1A is substantially a perspective view of another embodiment of the present invention wherein the support rod is resting atop the mounting brackets.
Figure 2:
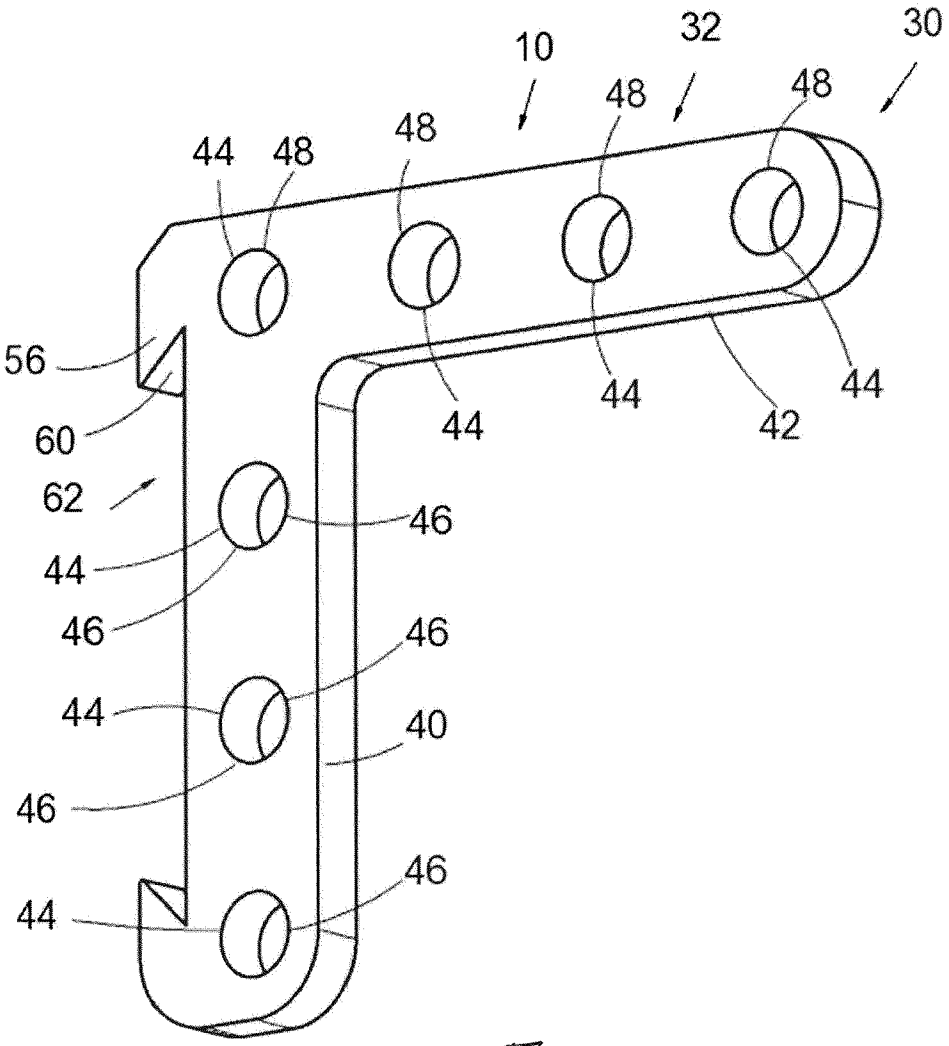
FIG. 2 is substantially a perspective view of one embodiment of the mounting bracket of the present invention.

As substantially shown in FIG. 2, the mounting bracket 32 could be made of an appropriate resilient material, such as high impact plastic, metal, wood or the like. In one embodiment, the mounting bracket 32 may have a generally inverted L-shape defining a leg portion 40 and foot portion 42. As substantially shown in FIGS. 1 and 1A, when the mounting bracket 32 is attached to a vertical wall 12, the leg portion 40 may run vertically along the vertical surface 12 while the foot portion 42 may project outward from the vertical surface 12 in a generally horizontal orientation.

Depending on the shelving needs, one possible orientation for the mounting bracket(s) 32 could present the foot portion 42 at the bottom of the leg portion 40. Another possible orientation (not shown) for the mounting bracket(s) 32 could have the mounting bracket 32 be inverted and present the foot portion 42 at the top of the leg portion 40.

When the attached mounting brackets 32 are placed or otherwise oriented to have the foot portion 48 project outward from the bottom of the leg portion 40, the leg portion 40 can used to support the top shelving rod(s) 36 while the foot portion 48 may be used to support the bottom shelving rod(s). When the foot portion 48 projects outward from the top of the leg portion 40, the foot portion 48 may be used to support the bottom shelving rod(s) 34 while the leg portion 40 may be used to support the top shelving rod(s) 36. In either version, the attached mounting brackets 32 could support the top shelving rods 36 in a position that may be higher or above the position of the supported bottom shelving rods 34. This height relationship could generally allow a support shelving rod 38 to partially pass through the generally upper placed top shelving rod 36 and have one top rod end of the support shelving rod come to rest in the generally lower placed bottom shelving rod 34.

The mounting bracket 32 could further define a plurality of rod apertures 44 could penetrate the mounting bracket 32 to continuously connect the two sides of the mounting bracket 32. The plurality of rod apertures 44 could comprise a set of leg rod apertures 46 located in the leg portion 40 and a set of foot rod apertures 48 located in the foot portion 42. Each set of foot rod apertures 48 may be spaced apart and linearly aligned in tandem to have a generally horizontal orientation e.g., when the mounting bracket 32 is attached to a vertical structure 12, like a wall.) Leg rod apertures 46 may be spaced-apart, linearly aligned in tandem, and generally be vertically oriented in the leg portion 40 (e.g., when the mounting bracket 32 may be attached to a vertical structure 12, such as a wall.)

In one possible embodiment, the rod apertures 44 of two or more mounting brackets 32 mounted to a vertical surface in a spaced apart fashion could removably receive rod ends 64, 70 of the top shelving rod(s) 36 and bottom shelving rod(s) 34 to suitable support the top shelving rods and bottom shelving rods. In another possible embodiment, where two or more mounting brackets 32 attached to a vertical surface 12 in a spaced-apart fashion could have the foot portions 42 located at the top of the leg portions, the rod apertures 44 could support only the bottom shelving rod(s) 34 while the top rod ends 70 of the top shelving rod(s) 36 may rest upon the tops of the foot portions 42 and generally would not otherwise engage the rod apertures 44. By moving the top shelving rod 36 along the tops of the supporting mounting brackets 32, the position of the support shelving rod 38 (as passing through the top shelving rod 36 to connect to the bottom shelving rod 34) could be adjusted between horizontal and vertical positions. As the support shelving rod's position is being adjusted, the support shelving rod 38 could further rotate the bottom shelving rod 34, which could be movably supported by respective rod apertures 44.

Figure 3:
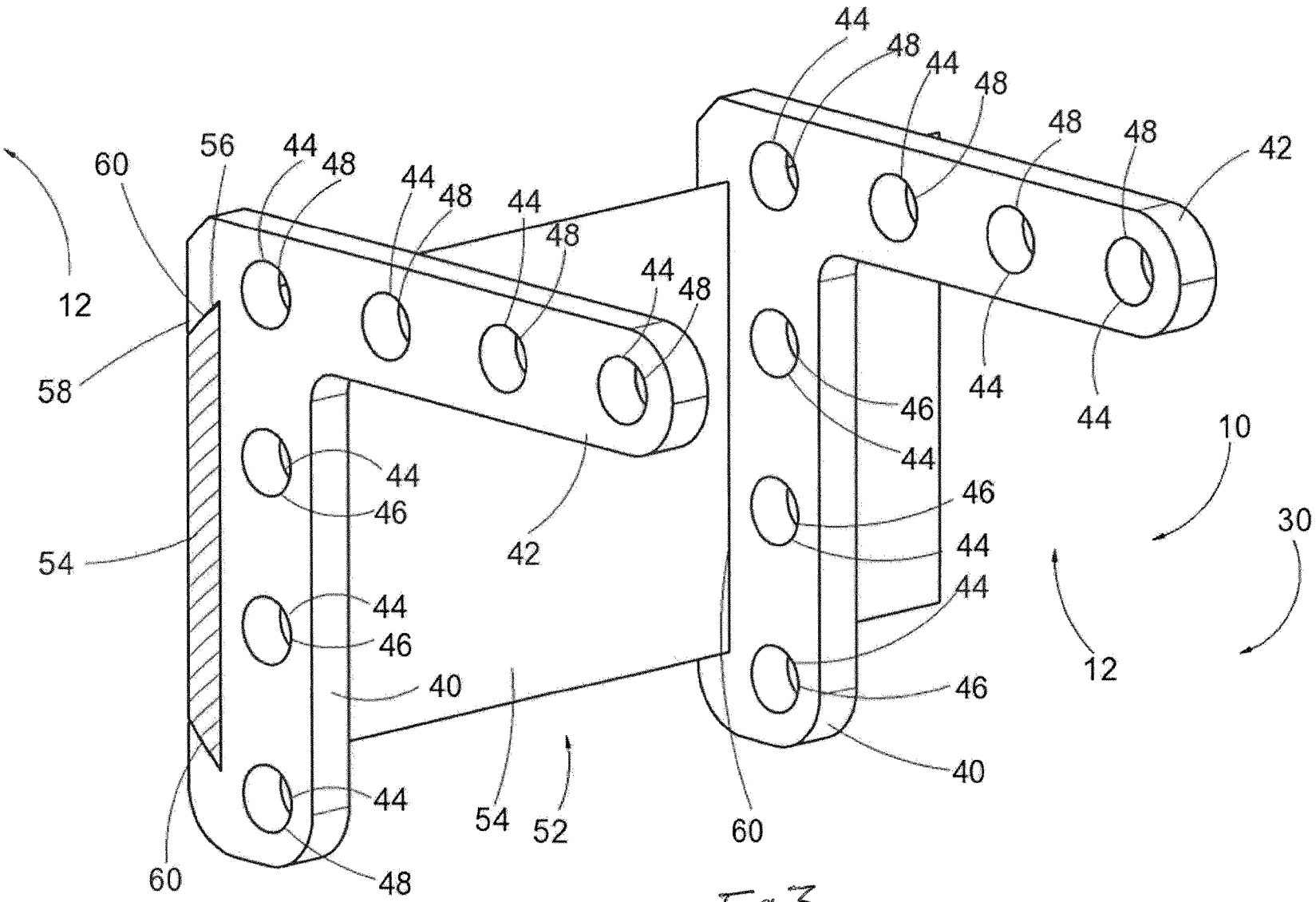
FIG. 3 is substantially a perspective view of one embodiment of the French cleat system version of the attachment device of the present invention.

The modular shelving system 30 could further comprise an attachment device 50 for attaching the mounting bracket 32 to a vertical surface 12 (e.g., a wall). In one version, the attachment device 50 could be based upon a French cleat system 52. As substantially shown in FIG. 3, the French cleat system 52 could comprise a first molding 54 that may be horizontally mounted upon vertical surface 12, such as a wall. The first molding 54 in one version could feature at least a top molding edge 54 substantially having a sufficient cross section shape (e.g., a sloped configuration) to removably interact with a second projection or second molding 58 formed by the mounting bracket 32. The second molding 58 could have a reciprocal slanted bottom bracket edge 60 that removably interacts with the top molding edge 56.

In another version not shown, the leg portion could further form an open channel or cutout that may form a reciprocal slanted bottom edge and have the ability to receive at least a portion of the first molding or like.

In another embodiment not shown, the attachment device 50 could comprise multiple double open-ended fastener channels (not shown) as generally defined by the leg portion 40 through which fasteners (e.g., screws) could pass through the mounting bracket 32 to attach the mounting bracket 32 to a vertical surface 12. Other attachment devices 50 could be used as well to attach the mounting brackets 32 to the vertical surface 12 and still be considered part of the invention 10.

Figure 4:
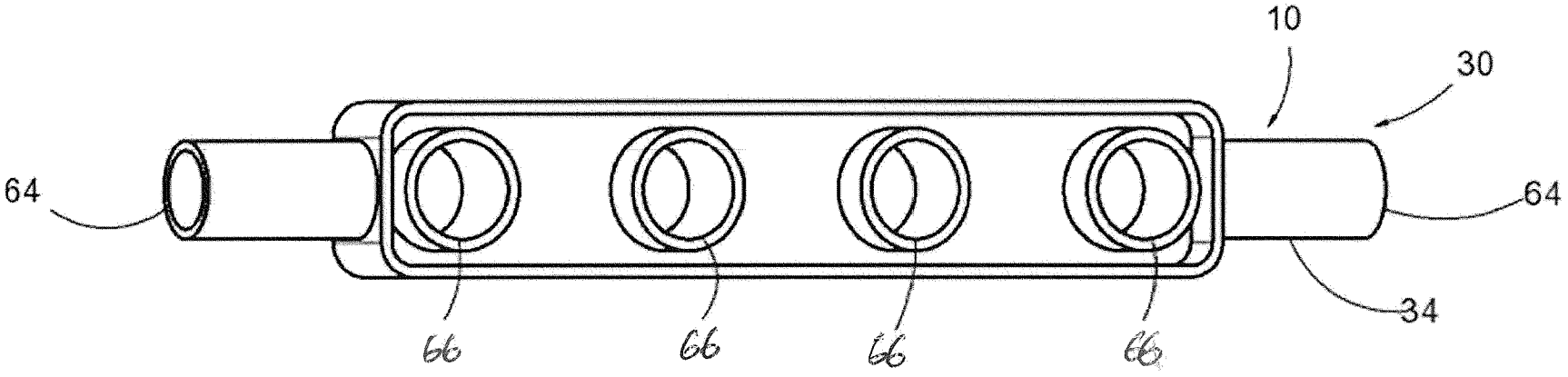
FIG. 4 is substantially a perspective front view of one embodiment of the bottom shelving rod of the present invention.
Figure 4A:
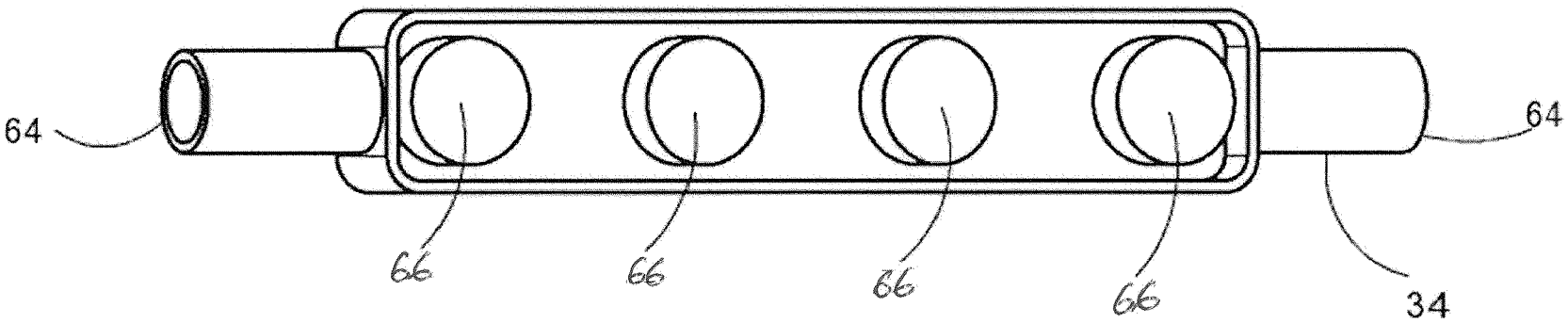
FIG. 4A is substantially a perspective back view of one embodiment of the bottom shelving rod of the present invention.

As substantially shown in FIGS. 4 and 4A, the bottom shelving rod 34, made of suitable resilient material (e.g., plastic, metal, wood or the like), could terminate in bottom rod ends 64 with a set of longitudinally aligned open-ended cups 66 located in between the bottom rod ends 64, each open-ended cups 66 could be configured to receive and support one support rod end 68 of a respective support shelving rod 38. Each bottom rod end 64 could be configured to be removably received within and supported by respective rod aperture 44.

The bottom shelving rod 34 could be supported by rod apertures 44 of at least two-spaced apart mounting brackets 32 removably mounted to a vertical surface 12. More specifically, in one version, the bottom shelving rod 34 could be inserted and resting upon respective rod apertures 44 of the leg portions 40 of the respective mounting brackets.

Figure 4B:
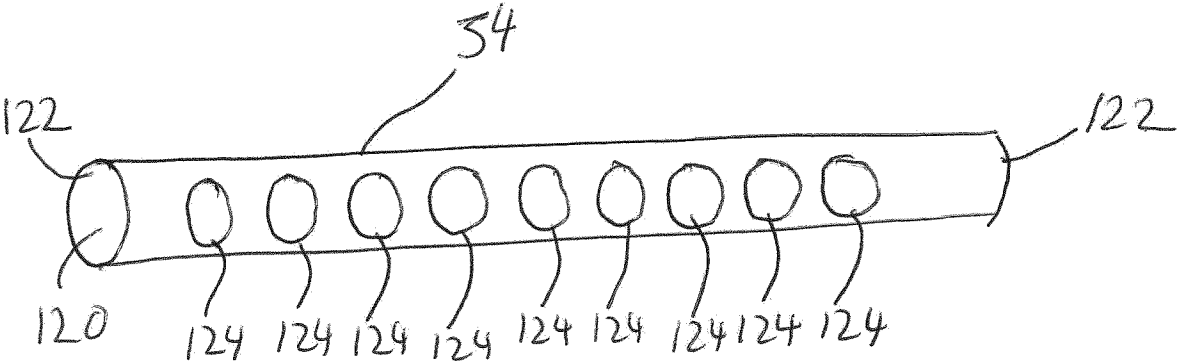
FIG. 4B is substantially a perspective view of another embodiment of the bottom shelving rod of the present invention.

As substantially shown in FIGS. 4B, another possible embodiment of the bottom shelving rod 34 could further define a bottom rod hollow interior 120. The bottom rod hollow interior 120 may continuously connect two open-ended bottom rod ends 122 (e.g., substantially forming a structure similar to tube or pipe.) The open-ended bottom rod ends 122 could be received in respective rod apertures 44 to have mounting brackets 32 receive and support the bottom shelving rod 34.

The bottom shelving rods 34 could further define a set of spaced-apart, tandem, longitudinally aligned support apertures 124 that penetrate the bottom shelving rod 34 to continuously connect with the bottom rod hollow interior XX. Each support aperture 124 could be removably receive and support one support rod end 68 of a respective support shelving rod 38. In passing through a respective support aperture 124, the support shelving rod end 68 could then come to rest upon a solid (i.e., unpenetrated) wall section of bottom shelving rod 34 that is located opposite of the said support aperture 124.

Figure 5:
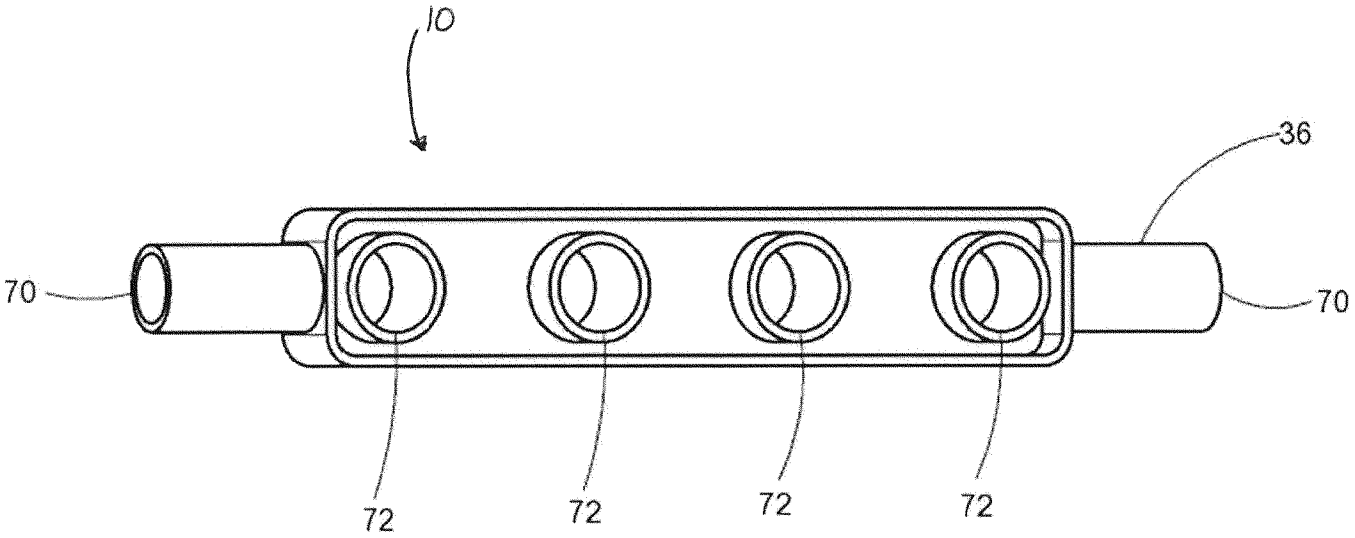
FIG. 5 is substantially a perspective view of one embodiment of the top shelving rod of the present invention.

As substantially shown in FIG. 5, the top shelving rod 36, made of suitable resilient material (e.g., plastic, metal, wood or the like) could be similarly configured like the bottom shelving rods 34. The top shelving rod 36 could terminate in top rod ends 70 with a set of top rod apertures 72 that pass through the respective top shelving rod 36. Each of the top rod apertures 72 could be configured to removably receive (e.g., allow to pass through) one respective support rod end 68 to allow the said support rod end 68 to be substantially removably received by a respective bottom shelving rod (i.e., be removably received by a respective open-ended cup 66.) The top shelving rod 36 could be supported by respective rod apertures 44 of at least two-spaced apart mounting brackets 32 as substantially removably mounted to a vertical surface 12.

Figure 5A:
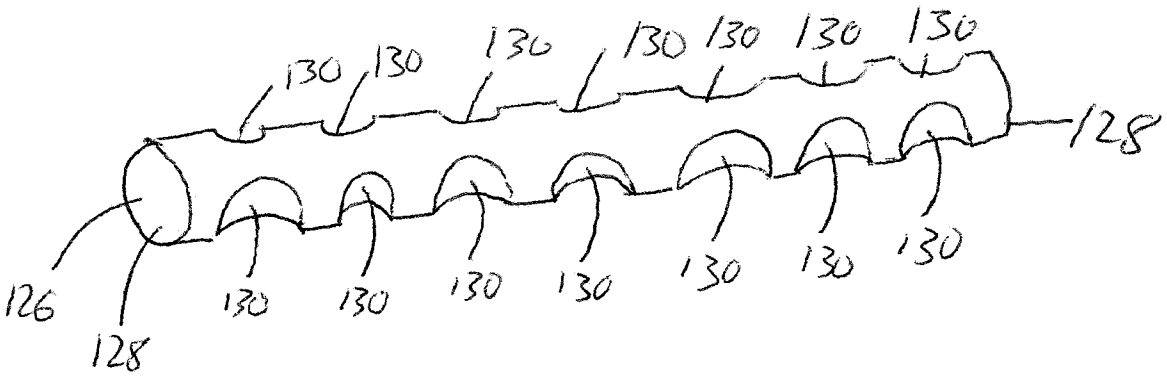
FIG. 5A is substantially a perspective view of another embodiment of the top shelving rod of the present invention.

As substantially shown in FIG. 5A, another possible embodiment of the top shelving rod 36 could further define a top rod hollow interior 126. The top rod hollow interior 126 may continuously connect two open-ended top rod ends 128 (e.g., substantially forming a structure similar to tube or pipe.) The open-ended top rod ends 128 could be received in respective rod apertures 44 to have mounting brackets 32 removably receive and support the top shelving rod 36.

The top shelving rods 36 could further define two sets of spaced-apart, tandem, longitudinally aligned top support apertures 124 that penetrate the bottom shelving rod 34 to continuously connect with the top rod hollow interior 126. One set of top support apertures 124 could be located opposite from the other set of top support apertures 124. The sets of top support apertures 124 could be so aligned to substantially allow passage of support shelving rods 38 through top shelving rod 36. In passing through a respective pair of aligned support apertures 124 (e.g., on the front and back sides of the top shelving rod 36, the support shelving rod end 68 could then come to rest in a respective open-ended cup 66.

Figure 6:
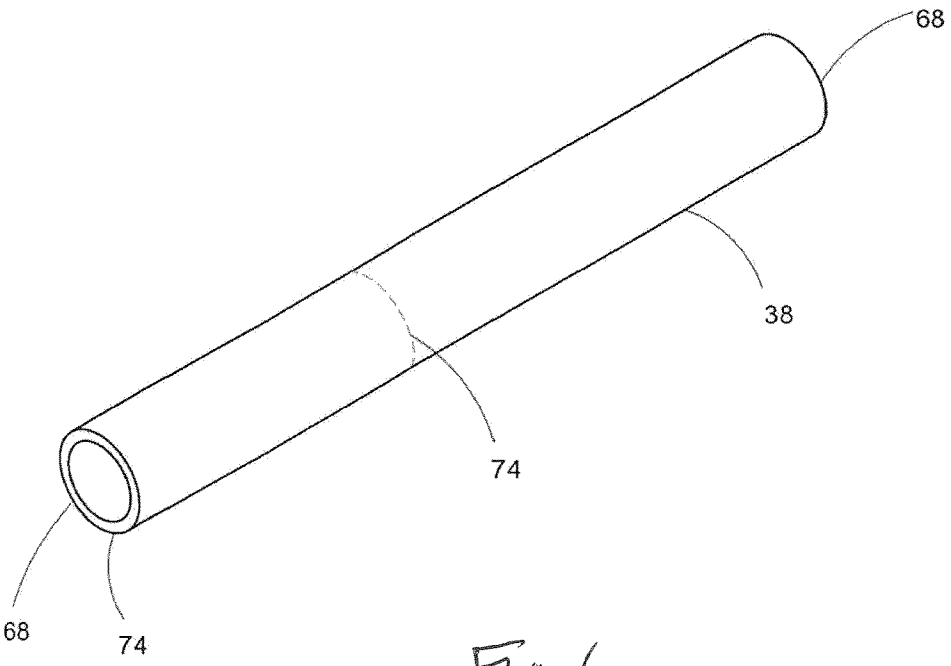
FIG. 6 is substantially a perspective view of one embodiment of the support shelving rod of the present invention.
Figure 7:
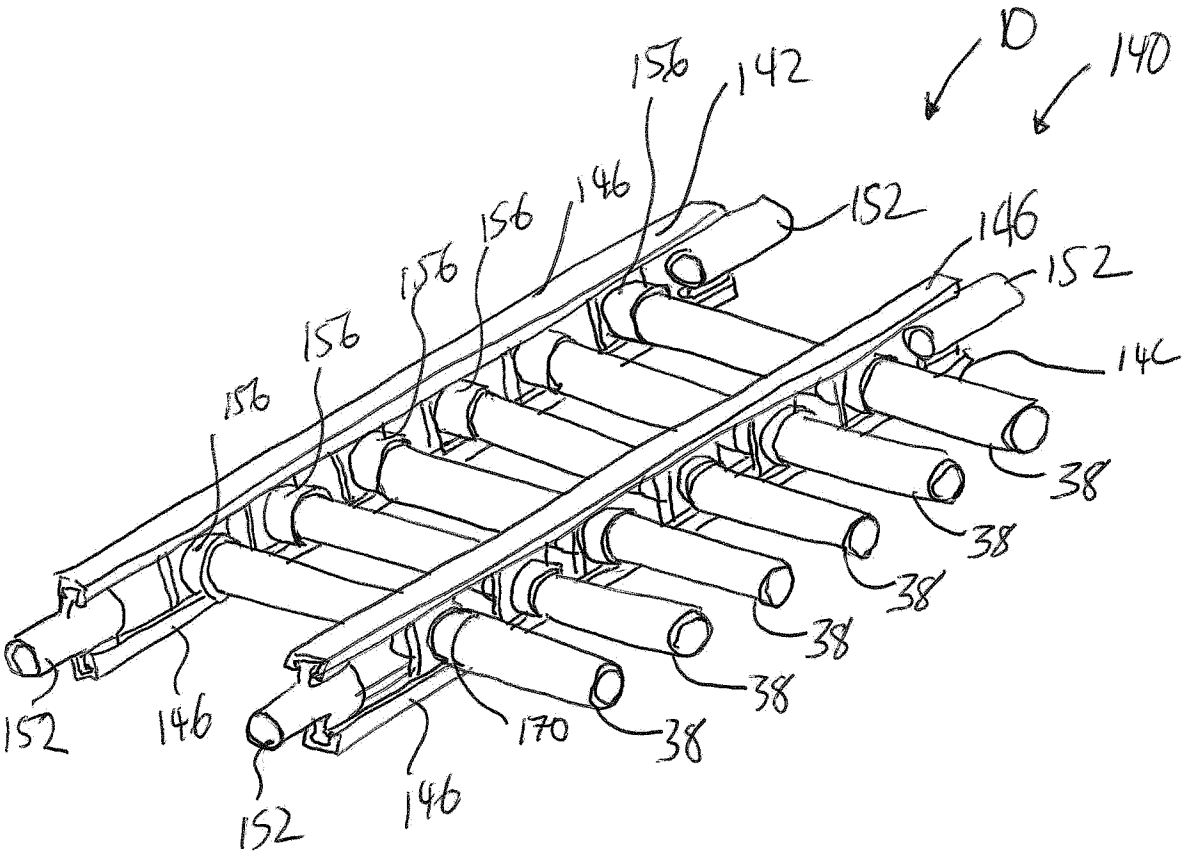
FIG. 7 is substantially a perspective view of one embodiment of the adjustable strut assembly of the present invention.
Figure 8:
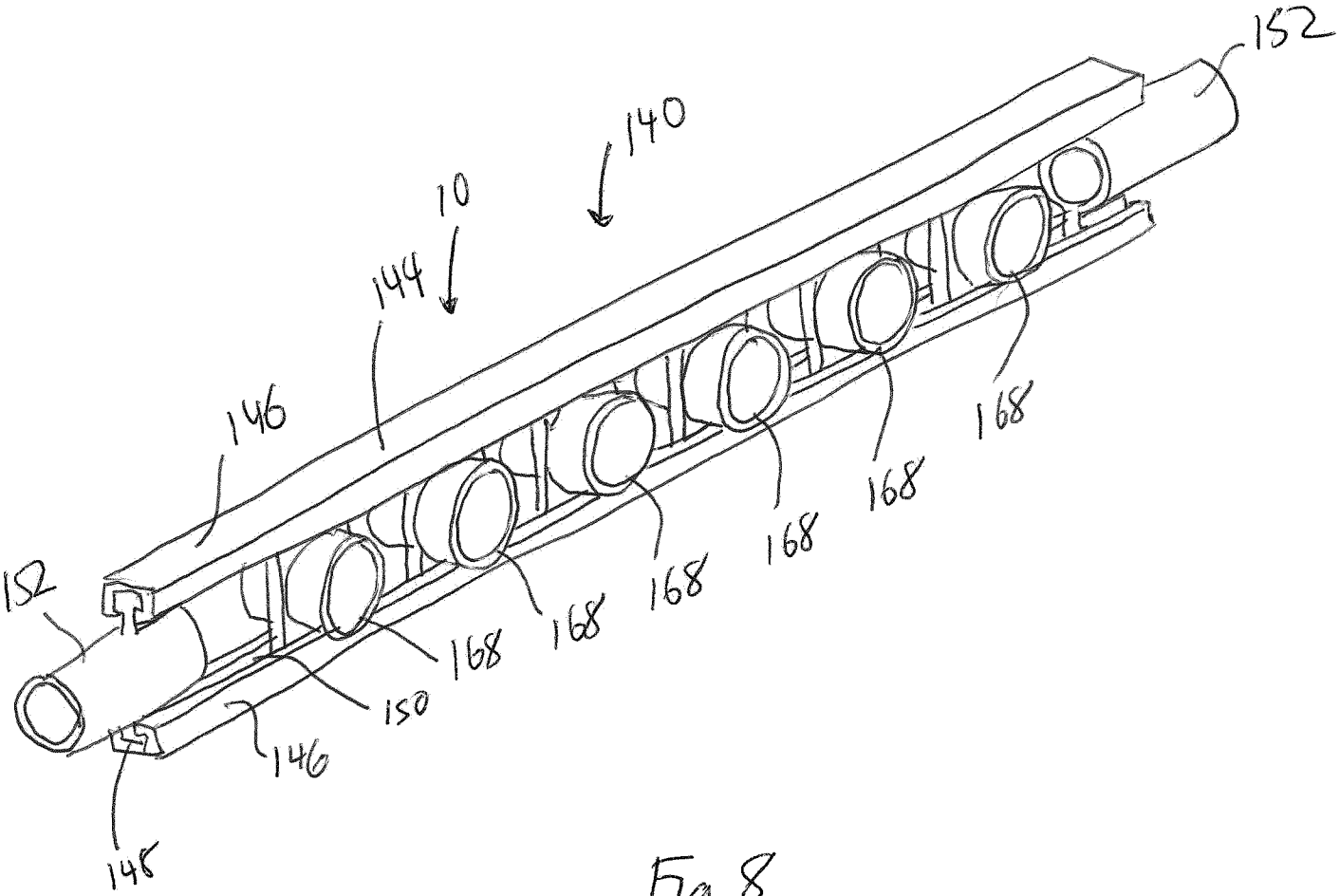
FIG. 8 is substantially a perspective view of the adjustable top shelving strut of the present invention.
Figure 9:
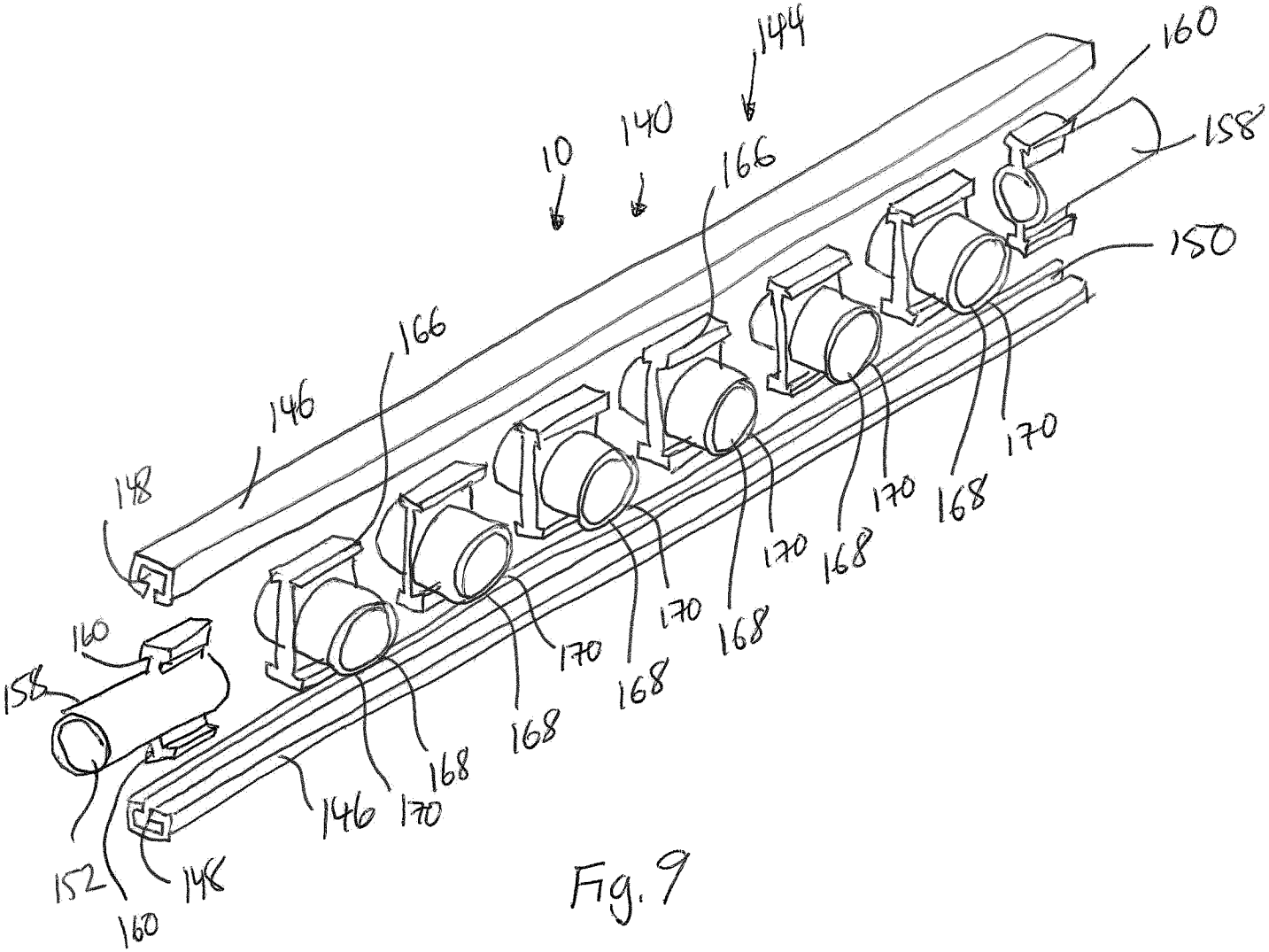
FIG. 9 is substantially a perspective exploded view of the adjustable top shelving strut of the present invention.
Figure 10:
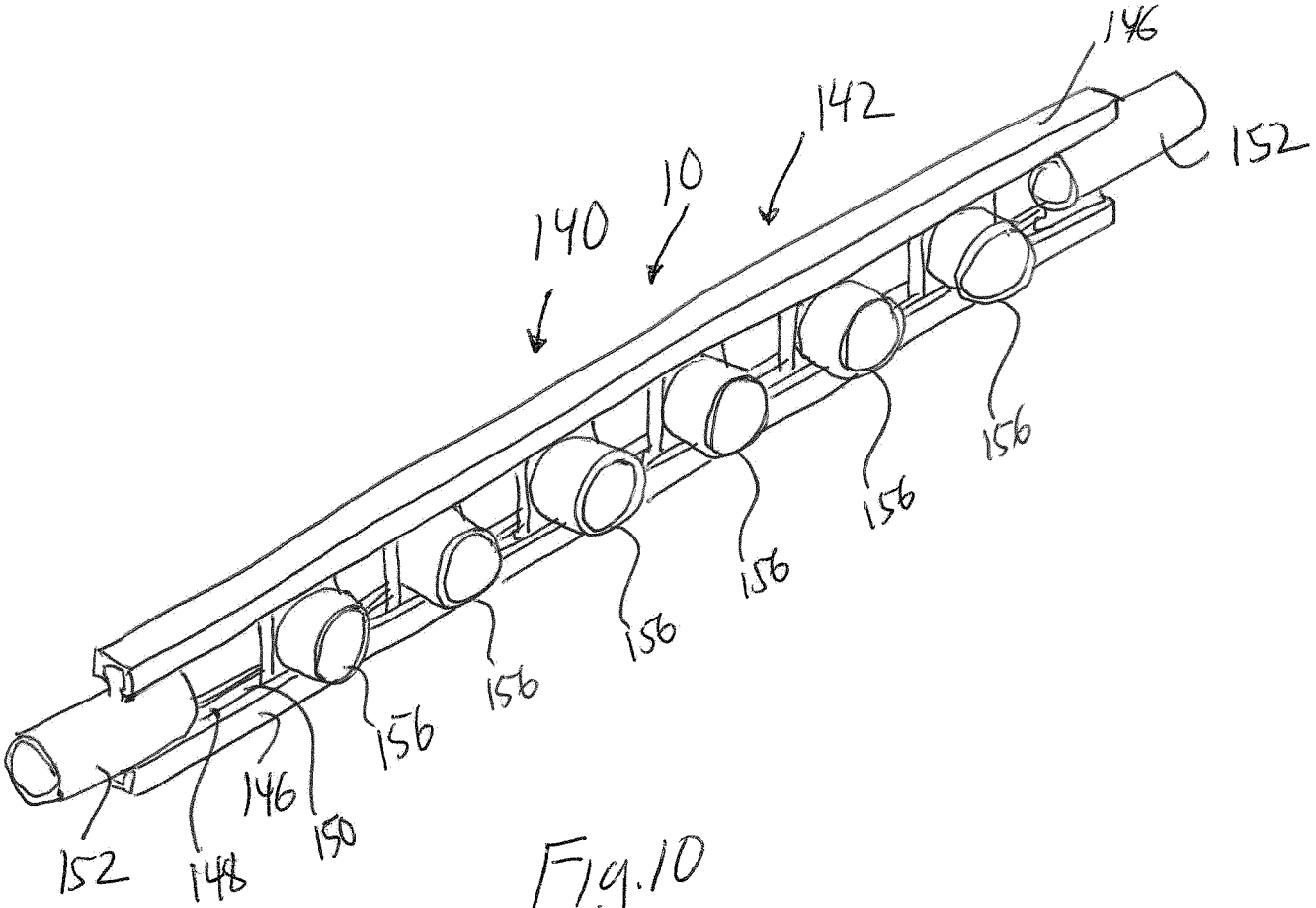
FIG. 10 is substantially a perspective view the adjustable bottom shelving strut of the present invention.
Figure 11:
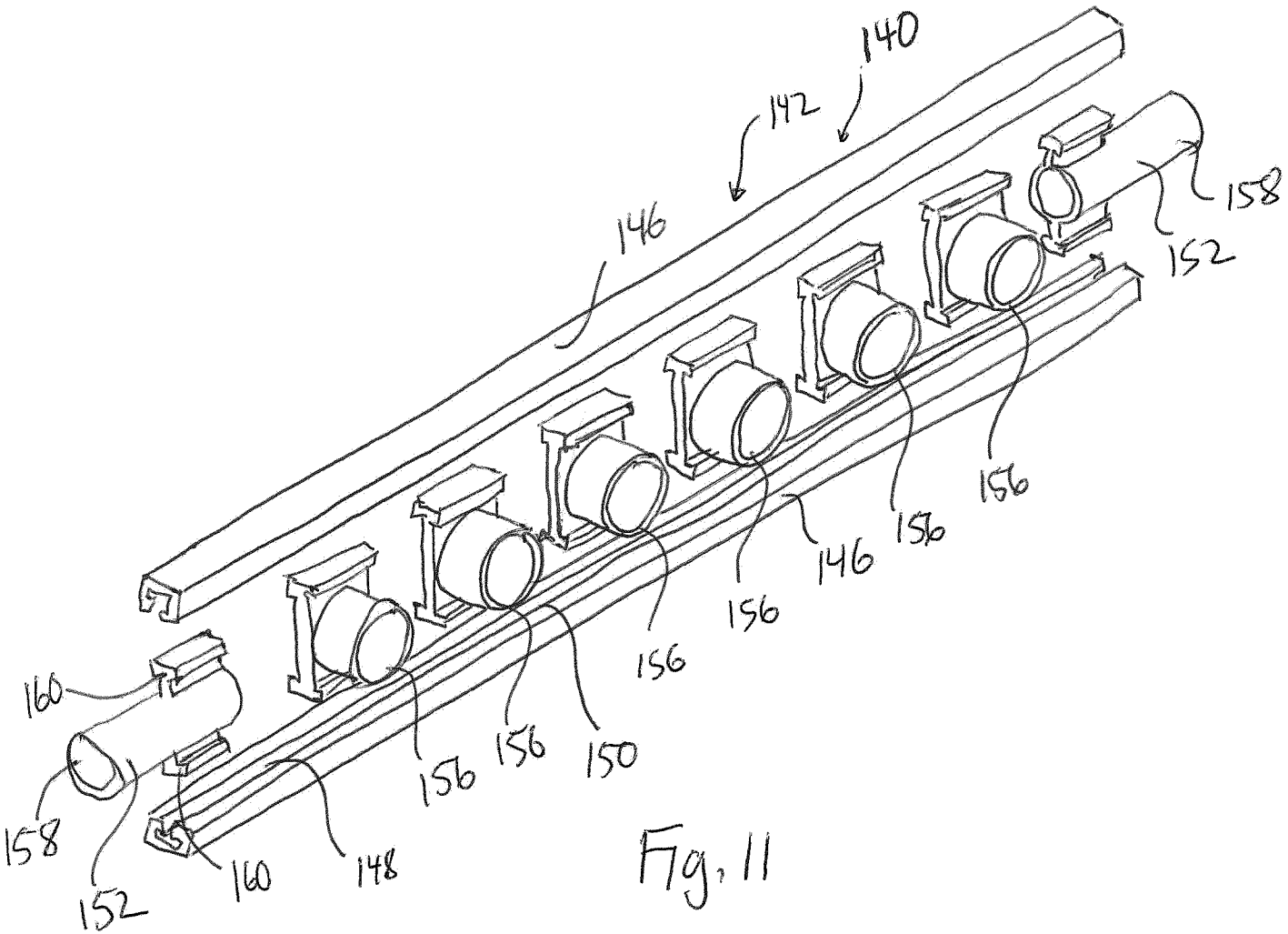
FIG. 11 is substantially a perspective exploded view of the adjustable bottom shelving strut of the present invention.
Figure 13:
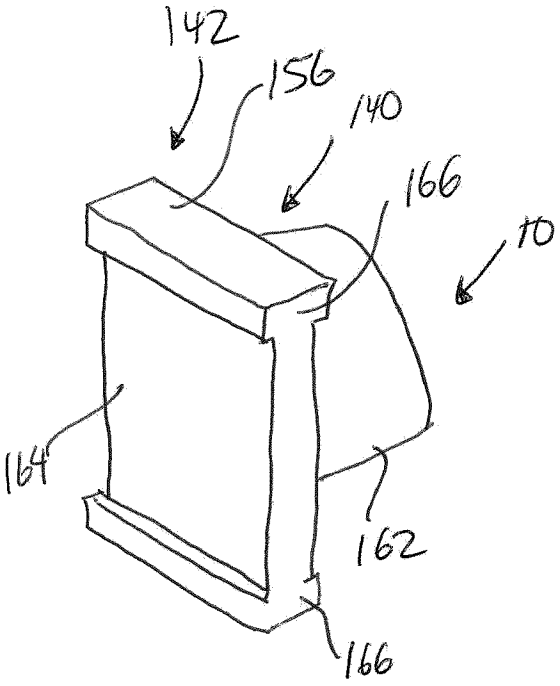
FIG. 13 is substantially a perspective back view of a slidable open-ended cap fitting for the adjustable bottom shelving strut of the present invention.
Figure 12:
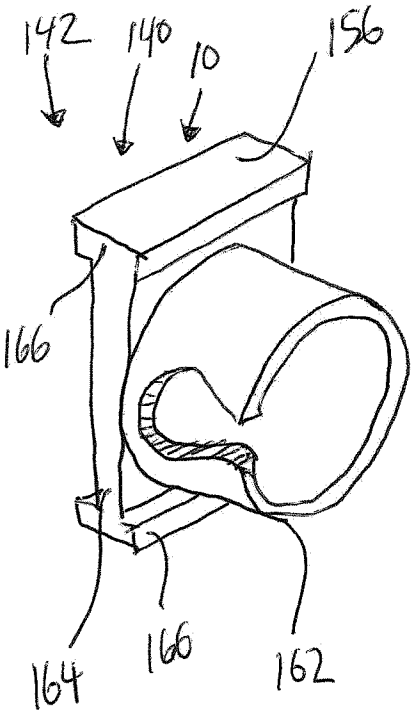
FIG. 12 is substantially a perspective front view of a slidable open-ended cap fitting for the adjustable bottom shelving strut of the present invention.
Figure 14:
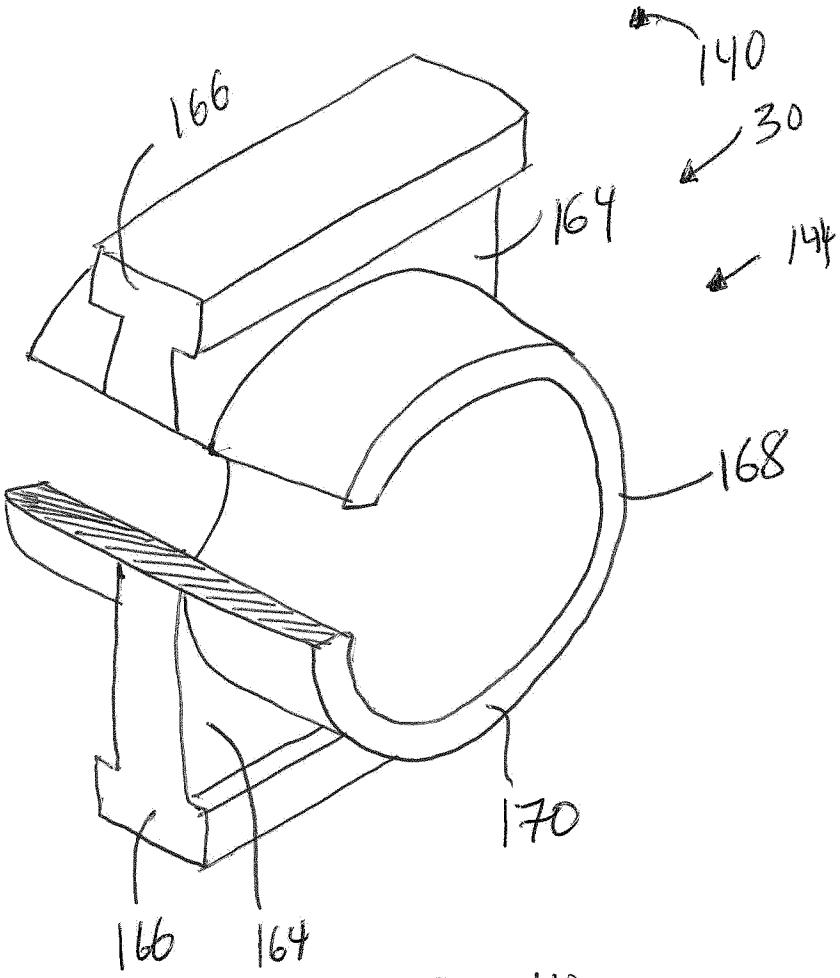
FIG. 14 is substantially a perspective view of a slidable aperture fitting for the adjustable top shelving strut of the present invention.
Figure 15:
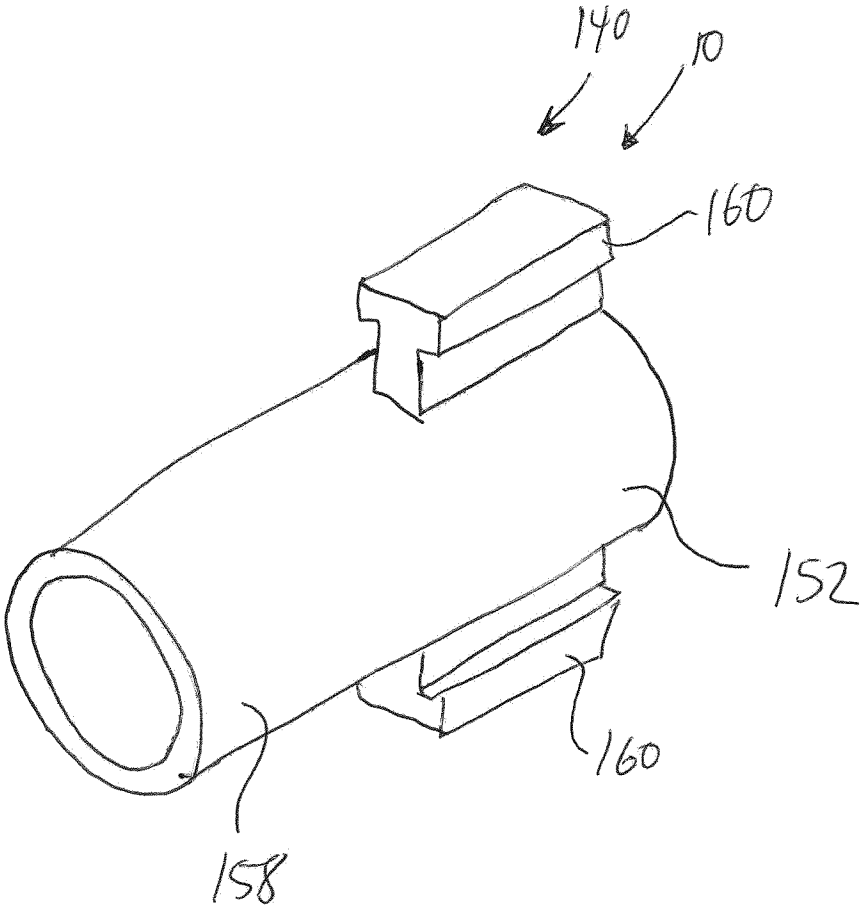
FIG. 15 is substantially a perspective view of an adjustable strut assembly endcap of the present invention.

As substantially shown in FIG. 6, the support shelving rod 38 could a simple rod made of suitable resilient material (e.g., plastic, metal, wood or the like) that could terminate in support rod ends 68 and may have a circumference 74 or radius configured to allow passage of the support shelving rod 38 through the top rod aperture 72 or top support aperture 130 and come to rest within the open-ended cups 66, or both.

As substantially shown in FIGS. 1 and 1 A, during assembly of the invention 10, support rod end 68 may removably pass through the respective top rod aperture 72 or top support apertures 130 and onto the respective open-ended cup 66 of the bottom shelving rod 34 that is placed in a position. Generally, the top shelving rod 36 is held in a position by the mounting brackets 32 that is above the position of the respective bottom shelving rod 34. This would allow support shelving rod 68 to slip down through the top shelving rod to come to rest upon the bottom shelving rod. In some embodiments, the bottom shelving rod 34 could be located above the top shelving rod 36, such as those embodiments where the shelving rods 38 are not specifically intended to hold anything (such as files, chisels, screw drivers, etc.).

A set of support shelving rods 38 could pass through a generally upper located top shelving rod 36 in a spaced-apart manner (e.g., via the top shelving rod's set of top rod apertures 72/top support apertures 130) and then rest into the set of open-ended cups 66 of a generally lower located bottom shelving rod 34. This rod orientation may be followed whether the mounting bracket has the foot portion location extending outward from the top or bottom of the leg portion. This interaction may allow those support shelving rods 38 to be held in an angled relationship between vertical and horizontal orientations to create the new shelving positions.

Items or materials (not shown) stored upon the support shelving rods may have portions (not shown) that need to project between supporting shelving rods 38 to properly rest upon the supporting shelving rods 38. The present embodiment of the invention 10 through fixed spacings between open ended cups 66 of the bottom shelving rod 34 and the fixed spacings between the top rod apertures 72 could result in fixed spacing between the support shelving rods 38 that may only accommodate items, tools or materials of similar dimensions or sizes. It may be necessary to be able to adjust or change the spacing between the support shelving rods 38 to accommodate a wider range of objects having different shapes and sizes that can be held by the support shelving rods 38.

As substantially shown in FIGS. 10-15, another embodiment of the invention 10, could be the adjustable strut assembly 140 utilizing adjustable bottom shelving struts 142 and adjustable top shelving struts to alter the spacing between the support shelving rods 38 to possibly resolve this tissue. The adjustable top shelving struts 144 and adjustable bottom shelving struts 142 could be held in between mounting brackets 32 and allow materials, items, tools and the like of different shapes and sizes to project non-uniform portions to project into adjustable spacing between the support shelving rods 38.

The adjustable strut assembly 140 could comprise mounting brackets 32, at least one adjustable bottom shelving strut 142, at least one adjustable top shelving strut 144 and one or more support shelving rods 38. The adjustable bottom shelving strut 142 could comprise pair of rails 146 having a lateral C-cross section 146 with a hollow rail interior with a longitudinal, open-center channel 150, two endcaps, and one or more open-ended cup fittings 156. The rails 146 could be held apart in parallel orientation by the two endcaps 152 located at respective ends of the rail pair to hold the rails 146 in a spaced-apart and parallel orientation so that each longitudinal open center channel 150 could face the other longitudinal open center channel 150.

The endcap 152 could have a rod (e.g., solid) or tube (e.g., hollow) body 158 wherein a pair of T-rail sections 160 could be longitudinally mounted on the body 158 with one T-rail section 160 could be located on a top of the body 158 while the other T-rail section 160 is longitudinally mounted opposite on a bottom of the body 158. Generally, the length of the T-rails section 160 is shorter than the length of the body 1587. The T-rail sections 160 could be located at the same end of the body 158, allowing the other end of the body 158 to be unencumbered by the T-rail presence and be removably and moveably received by a respective rod aperture 44.

The endcap 152 could engage an end of the rail pair by having the T-rail sections 160 move along respective longitudinal open center channels 150 until the T rail sections 160 have engaged with the rail hollow interiors 148 to hold the rails 146 in a spaced-apart and parallel orientation. The endcap 152 could be permanently attached to the rail pairs 146 by suitable means such as adhesive, fasteners (screws), snap held, and the like.

In between the two endcaps 152 could be the one or more open-ended cup fittings 156 (that could removably receive and support respective support rod ends 68) that are movable located between the two railings 146 (e.g., the endcaps movably engaging the two open center channels. The one or more the open-ended cup fittings 156 could be positioned along the lengths of the railing pair as needed to adjust spacing between adjacent the support shelving rod(s).

The open-ended cap fittings 156 could comprise a single open-ended tube 162 that is sealed at one end and open at the other end with square or rectangular shaped flange 164 projected laterally outward from the center of the single open-ended tube 162. At the top and bottom of the flange 164 is a T-projection 162 that movably engages the respective hollow rail interior 148 and allows the open-end cup fitting 156 to move along the open center channels 150.

The adjustable top shelving strut 144 is similarly constructed to adjustable bottom shelving strut 142. The adjustable top shelving strut 144 has the aperture fittings 164 instead of open-ended cup fittings 156. The aperture fittings 164 are quite similar to the open-ended cup fittings 156 except that aperture fitting 164 has a double-opened tube 170 instead of the single open-ended tube 162 to allow passage of the support shelving rod.

Adjusting the positions of the open-ended cup fittings 156 and the aperture fittings 164 along the lengths of their respective rail pairs 146, the spacing between the various support shelving rods 38 of the adjustable strut assembly 140 can be adjusted as desired or needed to accommodate various tools and other objects that may have dissimilar dimensions and shapes that are being held by the adjustable strut assembly between the support shelving rods or in (not shown) hollow open-ended support shelving rods.

Method

Figure 16:
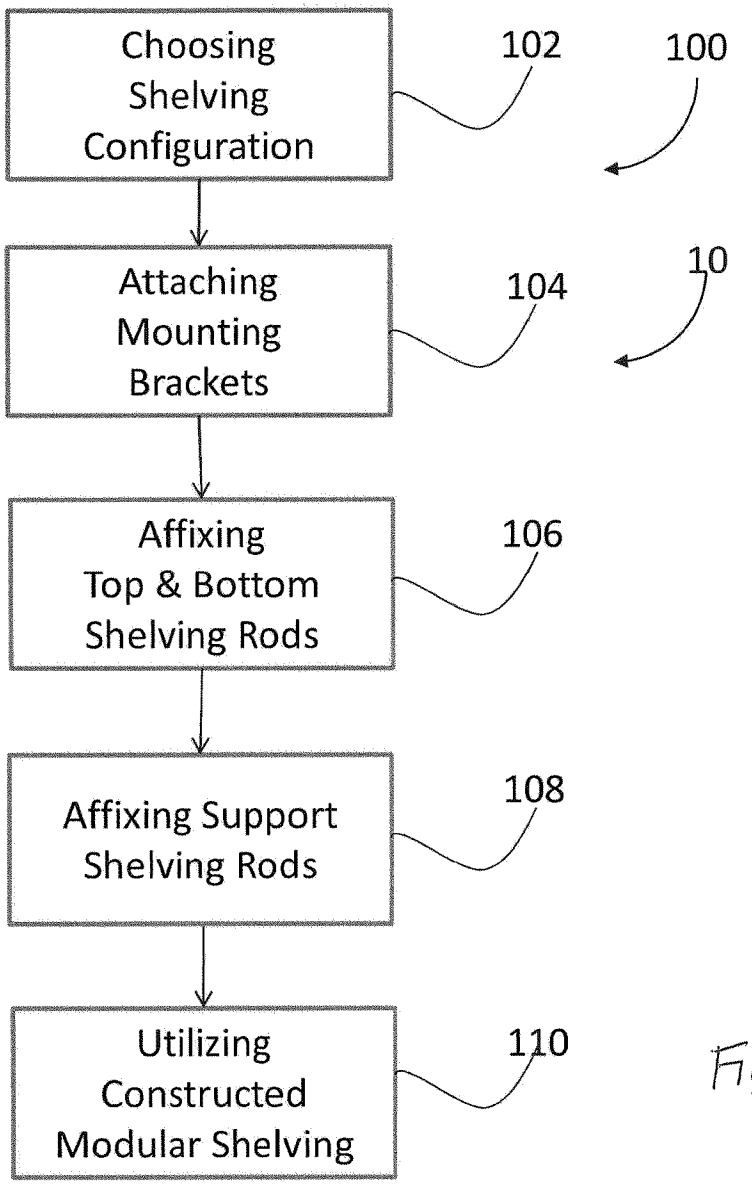
FIG. 16 is substantially a flowchart schematic showing one possible embodiment of a process or method for the present invention.

As substantially shown in FIG. 16, the method or process 100 for the invention 10 could start with step 102 choosing shelving configuration. In this step, the operator could decide where the shelving is to be applied (e.g., vertical surface such as a wall); on what objects are to be held by the invention; and which if any said objects should be supported by angled shelving. If one or more objects needed to be supported by angled shelving, then the operator could then design what versions of the shelving could be erected and how many shelving versions could be utilized together.

The selected shelving version(s) could first depend first on two or more mounting brackets being attached to a vertical structure (e.g., should be positioned as L-Shaped (vertical portion is generally located above the horizontal portion) or as inverted L-shape (vertical portion is generally located below the horizontal portion). The attachment system for attaching the mounting brackets could be chosen next (e.g., French cleat, fastener and the like). The operator could then obtain the necessary shelving materials such attachment device(s), bottom shelving rods, top shelving rods, and support shelving rods and the like. Once this step is substantially completed, the process could proceed to step 104, attaching the mounting brackets.

At step 104, attaching mounting brackets could include attaching mounting bracket to vertical surface. If a French cleat or like is used, the molding or like could be horizontally affixed to the vertical surface for the mounting brackets to rest upon, removably and movably engage the vertical surface. The mounting brackets could be placed upon the molding (with the mounting brackets oriented in ether L-shaped configuration or inverted L-shaped configuration) and be spaced apart from one and other. In this manner, a pair of mounting brackets can be used to make one portion of the shelving, by increasing/decreasing the spacing between the two mounting brackets to allow top and bottom shelving rods to be fitted between and into the mounting bracket pair. In reverse this allows the built shelving structure to be easily taken apart and down, to allow the same pieces to be reused to make soma or different angled shelving.

If a different attachment device, such as fasteners (e.g., screws), then the mounting brackets, top and bottom rods may be first assembled into the desired shelving unit and then said assembled desired shelving unit may then be attached intact to the vertical surface by fasteners.

When this step is substantially completed, the process 100 may proceed to step 106 affixing the top and bottom shelving rods.

In step 106, affixing top and bottom shelving rods, the mounting brackets could be spaced apart to allow the bottom shelving rod to have one rod end be placed in one of the rod apertures of a leg portion of one mounting bracket. In one version, the top shelving rod could also have one rod end placed in the rod aperture of the foot portion of the one mounting bracket. In another version, the top shelving bracket is placed to rest its respective rod ends atop the respective foot portions of the pair of mounting brackets.

When this step is substantially completed, the process 100 may proceed to step 108 affixing the support shelving rods.

In step 108, affixing the support shelving rods, a support rod end can be inserted through a top rod aperture to generally allow the passage of a portion of the support rod through the top rod aperture so the support rod end may come into general contact and rest in with an open-ended cup of the bottom support rod, the open-ended cup being generally aligned with the respective top rod aperture. This support shelving rods insertion action can be repeated to introduce more support shelving rods to create the angular modular shelving unit that is desired.

When this step is substantially completed, the process 100 may proceed to step 110 utilizing the constructed modular shelving unit.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A modular rod-based shelving system comprising:

(A) a set of mounting brackets, each mounting bracket from the set of mounting brackets is configured to support at least one bottom shelving rod and at least one top shelving rod in a first spaced-apart and parallel orientation to each other;

(B) an attachment device for securing a respective mounting bracket from the set of mounting brackets to a vertical surface;

(C) the at least one bottom shelving rod terminates in bottom rod ends, between said bottom rod ends are a tandemly located, longitudinally aligned series of open-ended cups;

(D) the at least one top shelving rod terminates in top rod ends, between the top rod ends are tandemly located, longitudinally aligned series of top rod apertures;

(E) at least one support shelving rod that terminates in support rod ends, the at least one support shelving rod having a circumference that allows a passage of the least one support shelving rod through one respective top rod aperture from the series of top rod apertures and one support rod end that fits into one respective opened-end cup from the series of open-ended cups;

wherein at least two mounting brackets of the set of mounting brackets are placed in a second parallel and spaced-apart orientation to support both the at least one top shelving rod and the at least one bottom rod, wherein the at least one top shelving rod and the at least one bottom rod supports the at least one support shelving rod in a sloped position.

2. The modular rod-based shelving system of claim 1 wherein the at least one support shelving rod perpendicularly passes through the at least one top shelving support rod to connect to the least one bottom shelving rod.

3. The modular rod-based shelving system of claim 2 wherein the at least one support shelving rod perpendicularly connects to the at least one bottom shelving rod rod, and one support rod end of the at least one support shelving rod removably rests within one open-ended cup from the series of tandem oriented, longitudinally aligned, open-ended cups.

4. The modular rod-based shelving system of claim 1 wherein the at least one top shelving rod rests upon respective tops of at least two mounting brackets from the set of mounting brackets.

5. The modular rod-based shelving system of claim 4 wherein a placement of the at least one top shelving rod and the respective tops of the at least two mounting brackets from the set of mounting brackets establishes the sloped position of the at least one support shelving rod.

6. The modular rod-based shelving system of claim 5 wherein, when in use, a movement of the at least one top shelving rod along the respective tops of the at least two mounting brackets results in a rotation of the at least one bottom shelving rod.

7. The modular rod-based shelving system of claim 5 wherein the at least one bottom shelving rod is supported by either foot portions or leg portions of the at least two mounting brackets.

8. A modular shelving system comprising:

(A) at least two mounting brackets;

(B) at least one bottom shelving rod that defines at least one open-ended cup, (C) at least one top shelving rod that defines at least one top rod aperture penetrating laterally through the at least one top shelving rod;

(D) at least one support shelving rod, the at least one support shelving rod extends through the at least one top rod aperture and rests in the at least open-ended cup;

(E) the at least two mounting brackets directly support the at least one bottom shelving rod and the at least one top shelving rod;

wherein the at least two mounting brackets are attached to a vertical surface in a spaced-apart parallel manner to support the at least one bottom shelving rod and the at least one top shelving rod, wherein the at least one top shelving rod and the at least one bottom shelving rod support the at least one support shelving rod in a sloped position.

9. The modular shelving system of claim 8 wherein the at least one support shelving rod perpendicularly penetrates through the at least top shelving rod.

10. The modular shelving system of claim 8 wherein the at least one support shelving rod perpendicularly penetrates through the at least top shelving rod through the at least one top rod aperture.

11. The modular shelving system of claim 8 wherein the at least one support shelving rod perpendicularly rests in the at least one bottom shelving rod.

12. The modular shelving system of claim 8 wherein, when in use, the at least one top shelving rod is configured to move from one position on tops of foot portions of the at least two mounting brackets to a second position on the tops of the foot portions of the at least two mounting brackets.

13. A method for operating a modular shelving system comprising the following steps:

(A) providing the modular shelving system, the modular shelving system comprises at least two mounting brackets, at least one bottom shelving rod that defines at least one open-ended cup, at least one top shelving rod that defines at least one top rod aperture penetrating laterally through the at least one top shelving rod, and at least one support shelving rod;

(B) attaching the at least one bottom shelving rod and the at least one top shelving rod to the at least two mounting brackets so that the at least two mounting brackets support the at least one bottom shelving rod and the at least one top shelving rod;

(C) passing the at least one support rod through the at least one top rod aperture of the at least one top shelving rod so that one rod end of the at least one support shelving rod is inserted in the at least one open-ended cup of the at least one bottom shelving rod with the at least one support rod being held in a sloped position;

(D) attaching the at least two mounting brackets to a vertical surface in a spaced apart parallel manner.

14. The method of claim 13 further comprising the step of locating the at least one top shelving rod on respective tops of the at least two mounting brackets and the step of placing the at least one bottom shelving rod between the at least two mounting brackets.

15. The method of claim 14 further comprising the step of moving the at least one top shelving rod along the respective tops of the at least two mounting brackets to adjust the position of the at least one support shelving rod.

16. The method of claim 13 further comprising the step of moving the least one top shelving rod along tops of foot portions of the at least two mounting brackets.

17. The method of claim 13 further comprising the step of moving the least one top shelving rod along tops of foot portions of the at least two mounting brackets.

18. The method of claim 17 wherein the step of moving the least one top shelving rod further comprises the step of rotating the at least one bottom shelving rod.

19. The method of claim 18 wherein the step of rotating the at least one bottom shelving rod further comprises moving the at least one support shelving rod from a first sloped position to a second sloped position.

20. The method of claim 13 wherein the attaching the at least two mounting brackets further comprising a step of affixing an attachment device to the vertical surface, the attachment device further securing a respective mounting bracket from the at least two mounting brackets to the vertical surface.

* * * * *